United States Patent [19]

Seki et al.

[11] Patent Number: 4,619,625

[45] Date of Patent: Oct. 28, 1986

[54] CONSTRUCTION TOY

[75] Inventors: Yoshizo Seki, Tokyo, Japan; Sidney Bass, Los Angeles, Calif.

[73] Assignee: Tomy Kogyo Co. Inc., Tokyo, Japan

[21] Appl. No.: 745,406

[22] Filed: Jun. 14, 1985

[30] Foreign Application Priority Data

Sep. 18, 1984 [JP] Japan ..... 59-141502[U]

[51] Int. Cl.[4] ..... A63H 33/04

[52] U.S. Cl. ..... 446/89; 446/95; 446/197

[58] Field of Search ..... 446/89, 95, 94, 93, 446/96, 198, 197, 180, 176

[56] References Cited

U.S. PATENT DOCUMENTS

| | | | |
|---|---|---|---|
| 800,560 | 9/1905 | Faber et al. . | |
| 2,776,525 | 1/1957 | Ford . | |
| 3,153,300 | 10/1964 | Keech . | |
| 3,503,152 | 3/1970 | Aoki et al. . | |
| 3,765,693 | 10/1973 | Morrison et al. . | |
| 4,080,752 | 3/1978 | Burge | 446/89 |
| 4,259,806 | 4/1981 | Troll . | |
| 4,319,427 | 3/1982 | Way, Jr. | 446/198 X |

FOREIGN PATENT DOCUMENTS

| | | | |
|---|---|---|---|
| 965969 | 9/1950 | France | 446/198 |

*Primary Examiner*—Mickey Yu

*Attorney, Agent, or Firm*—K. H. Boswell

[57] ABSTRACT

A construction toy has a first module which includes a bellows and a bulb with a tube connecting the two. The bellows includes a connector on each of its ends. Second modules each having connectors which mate with the connectors on the bellows, attached to the respective ends of the bellows. Third modules, each having an axle having wheels located thereon, are connected to the second modules utilizing mating connectors. The wheels on the third module include a ratchet mechanism allowing for rotation in only one direction. Upon each compression of the bulb, fluid pressure is transmitted to the bellows to elongate it, and in so doing, one of the third modules is moved away from the other; and upon release of the bulb, the bellows shortens bringing the other of the third modules back toward the first. The ratchet mechanisms on the third modules allow for rotation of their wheels in only a single direction such that the construction toy is progressively moved forward upon each compression and subsequent release of pressure on the bulb.

14 Claims, 5 Drawing Figures

10
16
22
14
30
2
20b
38
64
12
34
22a
42
58
44
54
52
56
20a
26
18
22
14
4
4
22
2
22-1
30
64
20a-1
32
36

CONSTRUCTION TOY

BACKGROUND OF THE INVENTION

This application is directed to a construction toy primarily designed for use by preschool age children which includes a first module having a bulb operated bellows which is attachable to a second module, and, in turn, the second module is attachable to a third module. The third module has a set of wheels and a ratchet mechanism which controls them. Additional second and third modules are also connectable to the construction toy as well as are further modules of other types.

A series of construction toys, sold under the tradename of Popoids TM are ideally suited for preschool age children. They offer the preschool age child the opportunity to utilize his or her imagination in constructing a variety of toys, yet their component parts are better adapted to preschool age children than are other prior known construction toys.

The above referred to Popoids TM toys utilize components which are of a size which are easily manipulatable by a preschool age child, but are of a sufficient size so as to prevent them from getting scattered or lost, which sometimes happens with a collection of small parts and a small child. Further, the components are sized and shaped so as to be useable in a safe manner by a preschool age child. There are no extremely small objects which can be swallowed, no protruding edges which can cause injury, and no hard elongated parts which might accidentally be pushed into the eyes or ears, or otherwise injure the child. The currently known Popoids toys are static in nature. That is, they are incapable of motion independent of that inputted to them by the actual hand movement of the child.

BRIEF DESCRIPTION OF THE INVENTION

In view of the above, it is the broad object of this invention to improve the above referred to Popoids TM toys by incorporating therein additional construction modules which are capable of exhibiting movement other than direct hand movement of the toy by the child. It is an additional object of this invention to provide a construction toy which utilizes a simple mechanism in order to provide simple "remote control" of movement of the construction toy. Further, it is an object of this invention to provide a toy which, because of the engineering and manufacturing principles incorporated therein, is capable of a long and useful lifetime, yet it is economically available to the consumer.

These and other objects are achieved in a construction toy which comprises: a first module, said first module including a bellows, said bellows having ends, said bellows including a connector located at each of its ends, said bellows having a closed hollow interior with a single opening providing ingress and egress into the interior of said bellows; said first module further including an elongated hollow tube having ends, one of said ends of said tube attaching to said bellows opening; said first module further including a hollow bulb having a single opening, said bulb compressable, said opening of said bulb attaching to other of said ends of the tube, together said bulb, said tube and said bellows forming a closed fluid system whereby compression on said bulb elongates said bellow, and release of said compression on said bulb shortens said bellows; at least two second modules, each of said second modules including at least two connectors located thereon, the connectors on the ends of said bellows each attaching to one of the connectors on one of said modules so as to connect each of the ends of said bellows to one of said second modules; at least two third modules, each of said third modules having a base member, an axle, a first and a second wheel and a ratchet means; said base member including a connector located thereon, said connector on said base member connecting to one of said connectors on said second module so as to connect one of said third modules to one of said second modules; said axle journalled in said base member and including said first and said second wheel located on the ends of said axle on opposite sides of said base member, said ratchet means operatively associated with said base member and at least one of said wheels whereby said wheel is capable of rotating in a first direction and is inhibited from rotating in a second direction.

Further, these objects are achieved in a construction toy which comprises: a first module, said first module including a bellows, said bellows having ends, said bellows including a connector located at each of its ends, said bellows having a closed hollow interior with a single opening provided ingress and egress into the interior of said bellows; said first module further including an elongated hollow tube having ends, one of said ends of said tube attachable sealing to said bellows opening; said first module further including a hollow bulb having a single opening, said bulb compressable, said opening of said bulb attachable sealing to other of said ends of the tube, together said bulb, said tube and said bellows forming a closed fluid system whereby compression on said bulb elongates said bellow, and release of said compression on said bulb shortens said bellows; at least one second module, said second module including at least two connectors located thereon, the connector on one of the ends of said bellows attachable to one of the connectors on said second module so as to temporarily connect said bellows to said second module; at least one third module, said third module having a base member, an axle, a first and a second wheel and a ratchet means; said base member including a connector located thereon, said connector on said base member connectable to one of said connectors on said second module so as to temporarily connect said third module to said second module; said axis journalled on said base member and including said first and said second wheels located on the ends of said axle on opposite sides of said base member, said ratchet means operatively associated with said base member and each of said wheels whereby each of said wheels is capable of rotating in a first direction and is inhibited from rotating in a second direction.

In addition to the first, second, and third modules, additional modules can be utilized in conjunction with the first, second, and third modules to increase the complexity of, or novelty thereof, of the construction toy created by the child.

BRIEF DESCRIPTION OF THE DRAWINGS

This invention will be better understood when taken in conjunction with the drawings wherein.

Figure 1:
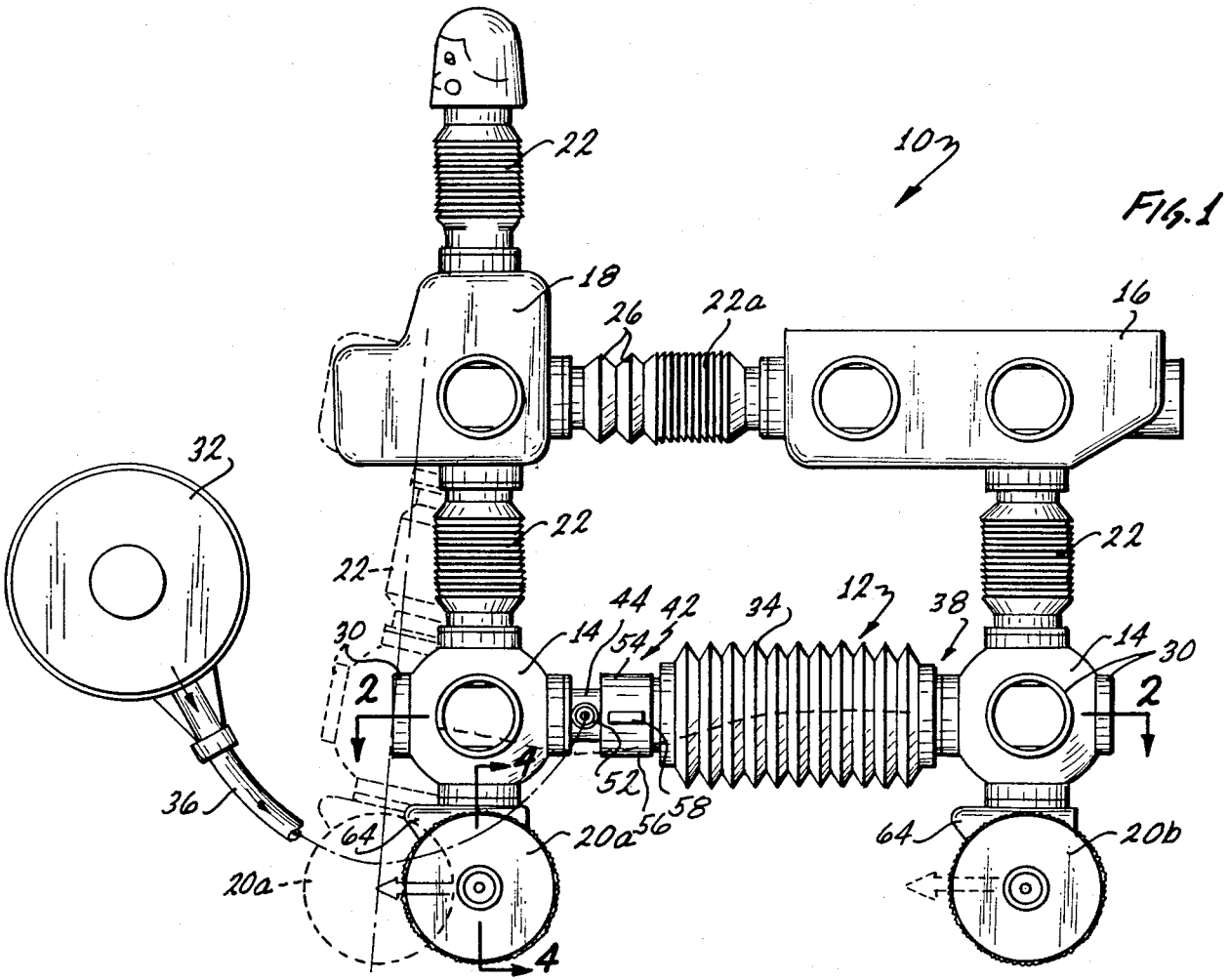
FIG. 1 is a side elevational view of a toy constructed utilizing individual modules as are described separately in other figures, the toy is shown in a first spacial orientation in solid lines, and a second spacial orientation in phantom lines.

The invention described in this specification and shown in the drawings, utilizes certain principles and/or concepts as are set forth in the claims appended hereto. Those skilled in the toy arts will realize these principles and/or concepts are capable of being utilized in a variety of embodiments which may differ from the illustrative embodiment utilized herein. For this reason, this invention is not to be construed as being limited solely to the illustrative embodiment, but should only be construed as being limited by the claims.

DETAILED DESCRIPTION OF THE INVENTION

In FIG. 1 a toy 10 formed of a plurality of individual modules is shown. For purposes of describing the toy, the modules can be divided into four types.

A first module comprises a power module 12. It has several component parts as hereinafter explained. The second modules are connector modules 14, 16, and 18. The third type of modules are wheel modules 20, two of which are utilized in the toy 10 of FIG. 1. And the fourth type of modules are tubular modules 22.

The tubular modules 22 are described in great detail in application Ser. No. 562,721, filed Jan. 16, 1984 entitled Construction Toy and assigned to the same Assignee as this application, the entire contents of which are herein incorporated by reference. For the purposes of this specification, the tubular modules 22 can be described as cylindrical elements which can be elongated and shortened, and include connectors 24 on the respective two ends of the tubular modules 22. The tubular modules 22 include a plurality of corrugated walls, collectively identified by the numeral 26, which can be nested within one another, as is described in application Ser. No. 562,721, or expanded out away from each other. As is shown for the tubular module 22A, in the upper part of FIG. 1, a portion of the tubular module 22 can be expanded and the remainder of the module can be maintained in the retracted or nested configuration.

The connector modules 14, 16, and 18, are also as is described in application Ser. No. 562,721. For the purposes of this specification, it can be described as having a body 28 which has a plurality of female connectors, collectively identified by the numeral 30, located thereon. For the modules 14, which are utilized to connect the wheel modules 20 to the power module 12, the bodies 28 have six individual female connectors 30 which are located in orthogonal positions with respect to one another. That is, two of them lie on an X axis, two of them lie on a Y axis, and two of them lie on a Z axis, with each of these axes being mutually perpendicular to the remaining two.

In simplest form a construction toy of the invention would utilize one power module 12, one connector, such as connector 14, and one wheel module 20. In order to form a semi-remote controlled vehicle, such as the toy 10 shown in FIG. 1, two connector modules 14 would be utilized in conjunction with two wheel modules 20.

The individual modules utilized to construct the toy 10 are temporarily assembled or connected together to form the toy 10. After so assembling the toy 10, the child utilizing the same can squeeze a rubber bulb 32, which forms a portion of power module 12, causing a bellows 34 (which also forms a portion of power module 12) to expand. Expansion of the bellows moves the front wheel module 20A forward with respect to the rear wheel module 20B to the position shown in phantom line in FIG. 1. When pressure on the bulk 32 is released, the bellows 34 contracts and the rear module 20B moves forward toward the front module 20A.

During movement of the front module 20A away from the rear module 20B, the tubular element 22A flexes along its length allowing for expansion of the lower portion of the toy 10 while still maintaining the intact structure of the totality of the toy 10. When the bellows 34 is retracted upon release of the pressure on the bulb 32, the tubular module 22A flexes back into a straight configuration, as is shown in FIG. 1.

The power module 12, in addition to the bulb 32 and the bellows 34, includes an elongated hollow tube 36. At one of its ends, the tube 36 connects to the bulb 32. The bulb 32 is sealed except for the single opening between it and the tube 36. Compression of the bulb, therefore, forces air into the tube 36, and release of any compression on the bulb 32 creates a vacuum within the tube 36.

Figure 2:
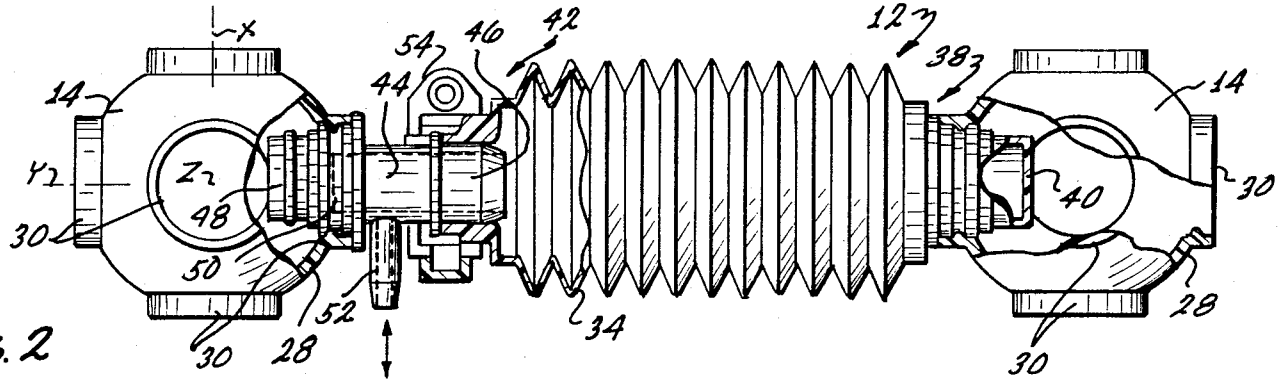
FIG. 2 is a plan view in partial section about the line 2—2 of FIG. 1.

As is seen in FIG. 2, the bellows 34 is formed as an elongated unit which is formed at end 38 into a male connector 40 which can fit into one of the female connectors 30 on the connector module 14. This allows for a temporary and reversible ble connection between the bellows 34 and the connector module 14.

The other end of the bellows 34, end 42, has a large opening therein. An end plug 44, which includes a hollow boss 46 as a component part thereof, fits into the opening in end 42 to seal it. The interior of the hollow boss, however, opens into the hollow interior of the bellows 34. The end plug 44 includes a male connector 48 which extends axially in line with the boss 46. The connector 48 includes a wall 50 formed therein which seals the end of the boss 46. A nipple 52 connects to the boss 46. The opening in the nipple 52 leads into the interior of the boss 46 which, in turn, leads into the interior of the bellows 34. Thus, the bellows 34 has a single opening, i.e., the nipple 52, allowing for ingress and egress of fluid to and from the bellows 34.

The other end of the tube 36 attaches to the nipple 52. When so attached, the interior of the bulb 32, the interior of the tube 36, the interior of the end plug 44, and the interior of the bellows 34, form a closed fluid chamber. In view of this, when the bulb 32 is compressed, the pressure is transmitted to the bellows 34 elongating the same; and when the compression on the bulb 32 is released, the inherent elasticity of the bellows 34 and the vacuum within the bulb 32 shortens the bellows 34. Thus, air moves up from the bulb 32 to the bellows 34 to elongate it, and moves in the other direction to shorten the bellows 34.

Figure 3:
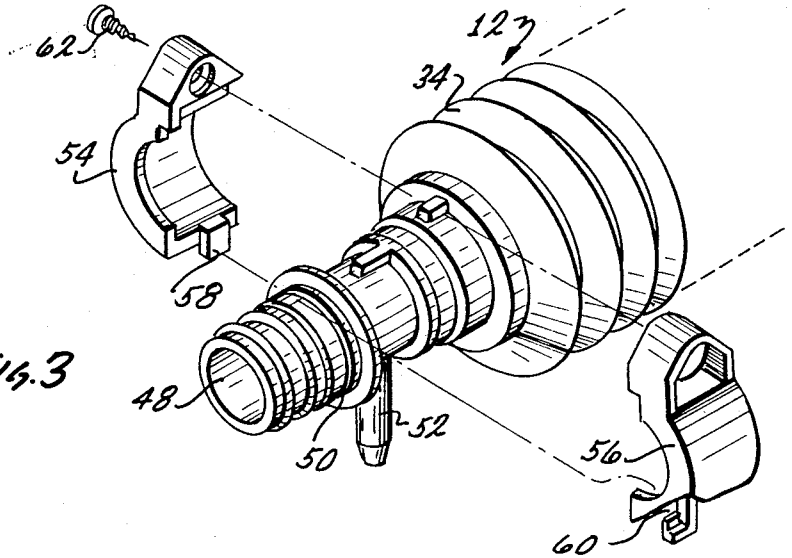
FIG. 3 is a fragmentary exploded view of one of the components seen in FIG. 1.

As seen in FIGS. 2 and 3, a retaining clamp formed of component pieces 54 and 56 is utilized to secure the end plug 44 to the end 42 of the bellows 34. A small projection 58, on the retaining component 54, fits into a small opening 60 on the retaining component 56 to hold the bottom portions of these two components 54 and 56 together, and a small screw 62 attaches the top portion of the retaining component 54 to the top portion of the retaining component 56. The screw 62 clamps the component 56 to the component 54 which, in turn, clamps the end plug 44 securely within the end 42 of the bellows 34 preventing expulsion of the same when the bulb 32 is compressed.

A male connector 48 on the end plug 44 fits into one of the female connectors 30 on one of the connector modules 14 to secure the other end of the bellows 34 to one of these connector modules 14. As seen in FIG. 1, the left hand side of the bellows 34 is connected to the left most connector module 14, and the right hand side of the bellows 34 is connected to the right most connector module 14. When so connected, connector modules 14 move away from and toward one another with respect to elongation and shortening of the bellows 34.

Figure 4:
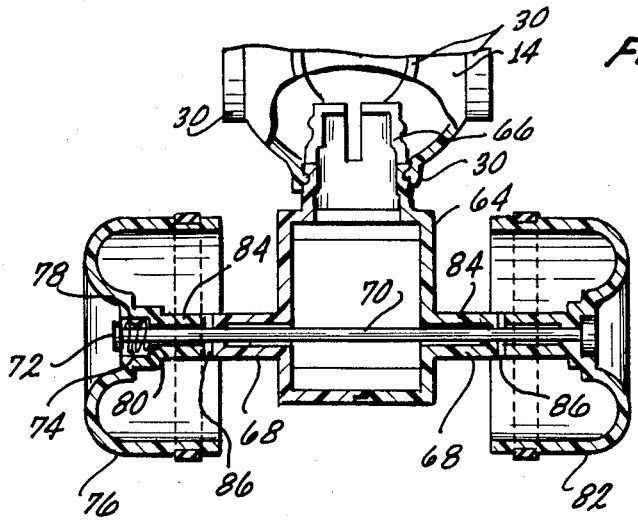
FIG. 4 is an elevational view in partial section about the line 4—4 of FIG. 1.
Figure 5:
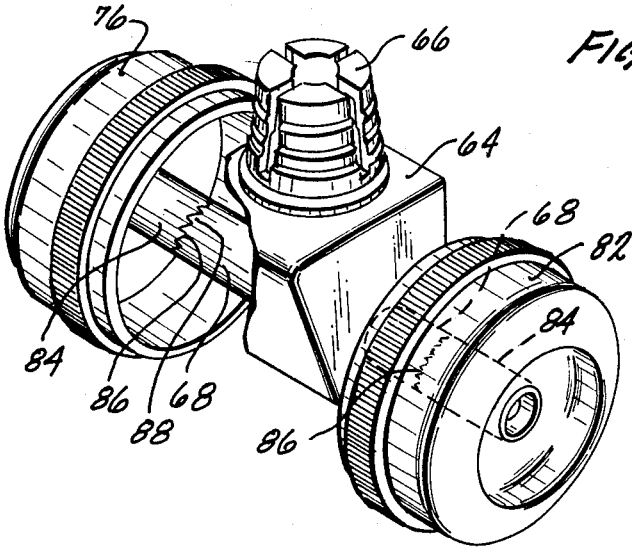
FIG. 5 is an isometric view of one of the components seen in FIG. 4 with portions of the structure partially removed for clarity of underlying components.

As seen in FIGS. 4 and 5, the wheel modules 20 include a base member 64 which has a male connector 66 formed thereon. The male connector 66 connects the base member 64 to one of the connector modules 14 by fitting into the female connector 30 on the connector module 14. The base member 64 includes left and right outwardly extending bosses, collectively identified by the numeral 68, which are hollow and which serve as bearings for an axle 70. On one of its ends, the axle 70 has a flanged head 72. A small compression spring 74 is placed around the axle 70 and positioned against the inside of the head 72. A first wheel 76 is now positioned on the axle 70. The wheel 76 has a small chamber 78 formed therein which fits around the spring 74. The chamber 78 includes a bottom wall 80 which abuts against the bottom of the spring 74. The spring 74 is, therefore, positioned between the head 72 and the bottom wall 80. The axle 70, containing the wheel 76 thereon, is then passed through the base member 64, and a further wheel 82 is pressure fit to the other end of the axle 70.

Each of the wheels, 76 and 82, have a hollow interior boss, collectively identified by the numeral 84, which serves two purposes. One of these is to form a support around the axle 70. The ends of the bosses 84 have a series of reentrant ratchet teeth 86 formed thereon. The ends of the bosses 68 have corresponding reentrant ratchet teeth 88 formed thereon. The ratchet teeth 86 lock with the ratchet teeth 88 to prevent rotation in one direction, but allow rotation in the opposite direction. Thus, in FIG. 5, the wheels 76 and 82 are free to rotate in a counterclockwise direction, but inhibited from rotating in a clockwise direction.

The wheel 76, if rotated counterclockwise as seen in FIG. 5, rotates because the teeth 86 ride up along the angular surface of the teeth 88, moving the wheel 76 outwardly from the base member 64 to compress the spring 74 between the head 72 and the bottom wall 80. When the wheel 82 is turned clockwise, its ratchet teeth 86 also slide with respect to the ratchet teeth 88, moving the wheel 82 outwardly with respect to the base member 64. Since the wheel 82 is fixed to the axle 70, the outward movement of the wheel 82, with respect to the base member 64, slides the axle 70 within the bosses 68, bringing the head 72 of the axle 70 inwardly toward the base member 64, which, in turn, also compresses the spring 74. Thus, the wheel 76, moving outwardly from the base member 64, slides along the axle 70 toward the head 72 to compress the spring 74; and the wheel 82, moving outwardly from the base member 64 in the opposite direction, slides the axle 70, such that the head 72 moves towards the base member 64, also compressing the spring 74. Irrespective of the source of compression of the spring, either by one wheel 76 or the other wheel 82, or both acting together, the bias imparted into the spring 74 tends to restore the mesh of the reentrant ratchet teeth 86 with respect to reentrant ratchet teeth 88, to prevent the rotation of the wheels 76 and 82 clockwise, as seen in FIG. 5, but allowing counterclockwise rotation, as seen in FIG. 5.

Referring back to FIG. 1, when the toy 10, as constructed in FIG. 1, rests on a support surface, and the bulb 32 is squeezed, fluid pressure is transmitted to the bellows 34 to elongate it. This moves the wheel module 20A with respect to the wheel module 20B. The pressure against the wheel module 20B would tend to rotate its wheels clockwise, as seen in FIG. 1, which, as noted above, is prevented by the locking of the reentrant ratchet teeth 86 with the reentrant ratchet teeth 88. Elongation of the bellows 34, however, pushes the wheel module 20A to the left, tending to rotate its wheels counterclockwise, which is allowed by slipping of the reentrant ratchet teeth 86 on the reentrant ratchet teeth 88. Thus, the back wheels, i.e., the wheels attached to the wheel module 20B, are locked with respect to backward movement along the support surface, but the wheels attached to the wheel module 20A are free to rotate to allow the wheel module 20A to move forward, i.e., to the left of FIG. 1. This moves the toy 10 from the position seen in solid line in FIG. 1 to that seen in phantom line.

When the pressure on the bulb 32 is released, and the bellows 34 shortens, the opposite is true with respect to the wheels attached to the wheel modules 20A and 20B. Now, the wheels attached to the wheel module 20A are biased so as to rotate clockwise, but they are locked with respect to rotation in this direction. The wheels attached to wheel module 20B are biased so as to rotate counterclockwise, and are free to do so. Thus, as the bellows 34 shortens, the wheels attached to the wheel module 20A lock against the support surface, and the wheels attached to the wheel module 20B roll, bringing the rear end of the toy 10 of FIG. 1 forward toward the front end, returning the toy from the position seen in phantom line to the position seen in solid line. However, this causes the toy 10 to progress forward along the support surface. Each time the bulb 32 is squeezed, the wheels attached to the wheel module 20A move forward, while the wheels attached to the wheel module 20B remain stationary. When the pressure on the bulb 32 is released, the wheels attached to wheel module 20A remain stationary, and the wheels attached to wheel module 20B move forward.

We claim:

1. A construction toy which comprises:

a first module, said first module including a bellows, said bellows having ends, said bellows including a connector located at each of its ends, said bellows having a closed hollow interior with a single opening providing ingress and egress into the interior of said bellows;

said first module further including an elongated hollow tube having ends, one of said ends of said tube attachable sealing to said bellows opening;

said first module further including a hollow bulb having a single opening, said bulb compressable, said opening of said bult attachable sealing to other of said ends of the tube, together said bulb, said tube and said bellows forming a closed fluid system whereby compression on said bulb elongates said bellow, and release of said compression on said bulb shortens said bellows;

at least two second modules, each of said second modules including at least two connectors located thereon, the connectors on the ends of said bellows each attachable to one of the connectors on one of said modules so as to temporarily connect one of the ends of said bellows to one of said second modules and the other of said ends of said bellows to the other of said second module;

at least two third modules, each of said third modules having a base member, an axle, a first and a second wheel and a ratchet means;

said base member including a connector located thereon, said connector on said base member connectable to one of said connectors on said second module so as to temporarily connect one of said third modules to one of said second modules;

said axle journalled in said base member and including said first and said second wheels located on the ends of said axle on opposite sides of said base member, said ratchet means operatively associated with said base member and at least one of said wheels whereby said wheels is capable of rotating in a first direction and is inhibited from rotating in a second direction.

2. The construction toy of claim 1 wherein:

each of said base members includes a first and a second ratchet means, one of said ratchet means operatively associated with said base member and one of said wheels, and the other of said ratchet means operatively associated with said base member and the other of said wheels, each of said first and said second ratchet means capable of allowing rotation of its associated wheel in one direction and inhibiting rotation of its associated wheel in the opposite direction.

3. The construction toy of claim 1 wherein:

said connectors on the ends of said bellows are male connectors;

said connectors on said second modules are female connectors;

said connectors on said base member of said third modules are male connectors.

4. The construction toy of claim 1 further including:

at least one fourth module, said fourth module having first and second connectors thereon;

said second module including at least three connectors located thereon, one of said connectors on said fourth module temporarily connectable to a connector on said second module.

5. The construction toy of claim 4 wherein:

each of said second modules include at least four connectors thereon, at least two of said connectors being positioned perpendicular to one another.

6. The construction toy of claim 1 wherein:

said connector on said third module comprises a male connector;

said male connector positioned perpendicular to the axial axis of said axle.

7. The construction toy of claim 2 wherein:

said connectors on the ends of said bellows are male connectors;

said connectors on said second modules are female connectors;

said connectors on said base member of said third modules are male connectors.

8. The construction toy of claim 7 including:

at least one fourth module, said fourth module having first and second connectors thereon;

said second module including at least three connectors located thereon, one of said connectors on said fourth module temporarily connectable to a connector on said second module.

9. The construction toy of claim 4 wherein:

each of said base members includes a first and a second ratchet means, one of said ratchet means operatively associated with said base member and one of said wheels, and the other of said ratchet means operatively associated with said base member and the other of said wheels, each of said first and said second ratchet means capable of allowing rotation of its associated wheel in one direction and inhibiting rotation of its associated wheel in the opposite direction.

10. The construction toy of claim 9 wherein:

said connector on said third module comprises a male connector;

said male connector positioned perpendicular to the axial axis of said axle.

11. A construction toy which comprises:

a first module, said first module including a bellows, said bellows having ends, said bellows including a connector located at each of its ends, said bellows having a closed hollow interior with a single opening providing ingress and egress into the interior of said bellows;

said first module further including an elongated hollow tube having ends, one of said ends of said tube attachable sealing to said bellows opening;

said first module further including a hollow bulb having a single opening, said bulb compressable, said opening of said bulb attachable sealing to other of said ends of the tube, together said bulb, said tube and said bellows forming a closed fluid system whereby compression on said bulb elongates said bellow, and release of said compression on said bulb shortens said bellows;

at least one second module, said second module including at least two connectors located thereon, the connector on one of the ends of said bellows each attachable to one of the connectors on one of said modules so as to temporarily connect said bellows to said second module;

at least one third module, said third module having a base member, an axle, a first and a second wheel and a ratchet means;

said base member including a connector located thereon, said connector on said base member connectable to one of said connectors on said second module so as to temporarily connect said third module to said second module;

said axle journalled in said base member and including said first and said second wheels located on the ends of said axle on opposite sides of said base member, said ratchet means operatively associated with said base member and each of said wheels whereby each of said wheels is capable of rotating in a first direction and is inhibited from rotating in a second direction.

12. The construction toy of claim 11 including:

at least one fourth module, said fourth module having first and second connectors thereon;

said second module including at least three connectors located thereon, one of said connectors on said fourth module temporarily connectable to a connector on said second module.

13. The construction toy of claim 12 wherein:

said connectors on the ends of said bellows are male connectors;

said connectors on said second module are female connectors;

said connector on said base member of said third modules is a male connector.

14. The construction toy of claim 12 wherein:

said second modules include at least four connectors thereon, at least two of said connectors being positioned perpendicular to one another.

* * * * *

UNITED STATES PATENT AND TRADEMARK OFFICE

CERTIFICATE OF CORRECTION

PATENT NO. : 4,619,625

DATED : OCT. 28, 1986

INVENTOR(S) : YOSHIZO SEKI AND SIDNEY BASS

It is certified that error appears in the above-identified patent and that said Letters Patent is hereby corrected as shown below:

Column 1, line 65, "bellow" should read --bellows--.

Column 2, line 24, "provided" should read --providing--.

Column 2, lines 27 and 30, "attachable" should read --attachably--.

Column 2, line 33, "bellow" should read --bellows--.

Column 2, line 47, "axis" should read --axle--.

Column 4, line 33, delete "ble".

Column 6, lines 62 and 65, "attachable" should read --attachably--.

UNITED STATES PATENT AND TRADEMARK OFFICE

CERTIFICATE OF CORRECTION

PATENT NO. : 4,619,625

DATED : OCT. 28, 1986

INVENTOR(S) : YOSHIZO SEKI AND SIDNEY BASS

It is certified that error appears in the above-identified patent and that said Letters Patent is hereby corrected as shown below:

Column 6, line 65, "bult" should read --bulb--.

Column 7, line 1, "bellow" should read --bellows--.

Column 7, line 24, "wheels" should read --wheel--.

Column 8, lines 33 and 36, "attachable"" should read --attachably--.

Column 8, line 39, "bellow" should read --bellows--.

Column 10, line 2, "modules" should read --module--.

Signed and Sealed this

Twenty-first Day of April, 1987

*Attest:*

*Attesting Officer*

DONALD J. QUIGG

*Commissioner of Patents and Trademarks*